US005081751A

United States Patent [19]

Pettigrew

[11] Patent Number: 5,081,751

[45] Date of Patent: Jan. 21, 1992

[54] APPARATUS FOR LIMITING THE MOVEMENT OF TENTER FRAME RAILS

[75] Inventor: Thomas G. Pettigrew, Greenville, S.C.

[73] Assignee: Marshall and Williams Company, Providence, R.I.

[21] Appl. No.: 575,851

[22] Filed: Aug. 31, 1990

[51] Int. Cl.[5] ..... D06C 3/02

[52] U.S. Cl. ..... 26/91

[58] Field of Search ..... 26/91, 89, 88, 87; 200/61.41, 61.42, 81.9 R

[56] References Cited

U.S. PATENT DOCUMENTS

| | | | |
|---|---|---|---|
| 2,375,990 | 5/1945 | Hinnekens | 26/91 |
| 2,879,892 | 3/1959 | Frokes | 200/81.9 R |
| 3,287,519 | 11/1966 | Coulliette | 200/81.9 R |
| 3,308,254 | 3/1967 | McMahon, Jr. et al. | 200/81.9 R |
| 4,131,977 | 1/1979 | Schiffers | 26/91 |
| 4,217,471 | 8/1980 | Ulbing | 200/81.9 R |
| 4,241,507 | 12/1980 | Clarey | 26/91 |
| 4,681,202 | 7/1987 | Dinse | 200/61.42 |

*Primary Examiner*—Werner H. Schroeder
*Assistant Examiner*—Amy Brooke Vanatta
*Attorney, Agent, or Firm*—Bailey & Hardaway

[57] ABSTRACT

Apparatus is illustrated for limiting the movement of tenter frame rails in order to avoid damage, particularly to chains, resulting from excessive movement which includes a spring biased plunger valve carried by the rail on one side of a rail junction, while the other side of the junction carries a member having a predetermined surface for actuating a switch when the member moves to an extreme position where it can no longer support the plunger against the resilient force of the spring, causing a switch to be activated to deactivate the motor imparting transverse movement to the rails.

3 Claims, 2 Drawing Sheets

APPARATUS FOR LIMITING THE MOVEMENT OF TENTER FRAME RAILS

BACKGROUND OF THE INVENTION

This invention relates to apparatus useful for adjusting the tenter rails so as to avoid excessive angles at the junctures between rails thus avoiding damage to the chains and rails. When changing cloth styles and widths, it is necessary to make transverse adjustments to the rails of a tenter frame in order to accommodate the changes. This operation may take place several times a day on cloth tenter frame rails where the tendency is to make shorter runs of cloth than heretofore. It has been found that the transverse adjusting screw activating mechanism may be driven excessively placing the rails at an angle such that damage is done to the tenter chains or other related mechanisms. While the invention has been described in connection with a textile tenter, this device would be useful in connection with a film tenter where adjustments are made for purposes of servicing chains adjusting for different film widths.

Accordingly, it is an object of this invention to provide an apparatus for limiting the angle of tenter frame rails utilizing a spring biased plunger carried on one side of a rail junction with an opposed member having a predetermined surface sufficient to support the spring biased plunger during normal movements of the rails which permits dislodgement of the spring biased plunger during excessive transverse movements of rails to signal a cessation of the rail driving mechanism or a warning system for a manually driven system.

Another important object of the invention is the provision of a rotatable cylindrical surface maintaining the plunger of a spring biased valve closed to flow during normal movement of tenter frame rails, but permitting dislodgement of the plunger therefrom when such movement is excessive in order to cause cessation of further excessive movement to the rails.

SUMMARY OF THE INVENTION

It has been found that apparatus may be provided for limiting the transverse movement of tenter frame rails by utilizing opposed brackets carried on respective rails at a junction and by providing a valve having a spring biased plunger on one bracket and a member having a plunger supporting surface on the other bracket to support same, except upon excessive movement of the rails. Excessive movement of the rails results in a switch being activated by a fluid flow resulting from dislodgement of the plunger from the member.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate apparatus for limiting the transverse movement of tenter frame rails having a transverse adjusting screw actuated mechanism driven by a motor at each junction between rails located in end to end relation. A pair of opposed brackets A and B are carried by respective ends of the rails. A valve has a spring biased plunger C carried by one of the brackets. A member D has a surface area of predetermined extent opposite the plunger maintaining same in closed position against the action of the spring so long as the plunger is in contact with such surface. A switch E is actuated by a flow of fluid through the valve when the plunger is released by the member D stopping the motor and bringing about a cessation of further transverse movement of the tenter frame rails.

Figure 3:
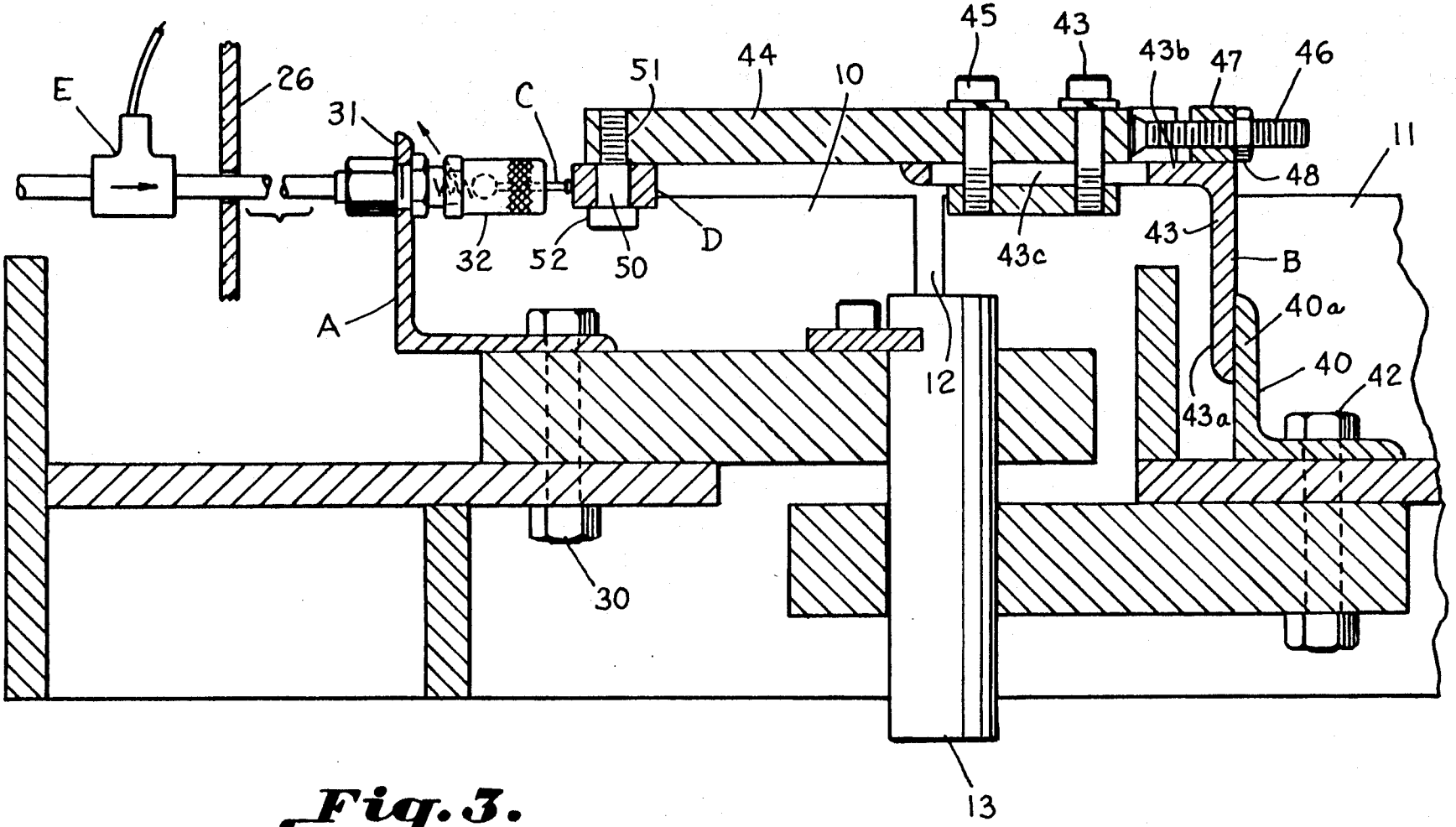
FIG. 3 is a transverse sectional elevation taken on the line 3—3 in FIG. 1.

The apparatus is illustrated as being located at the juncture of tenter frame rails 10 and 11 which are illustrated as having a space therebetween and being joined together by a hinge pin 13 (FIG. 3). The rails are illustrated as having a chain 14 running in the direction of the arrow opposite a similar chain 15 carried in the direction of the arrows in a juncture formed by rails 16 and 17 located on the opposite side of the tenter. A web is illustrated in the form of woven cloth 18 as between tenter clips 19 and 20 in FIG. 1. Any web may be utilized such as woven, non-woven and plastic film.

Figure 1:
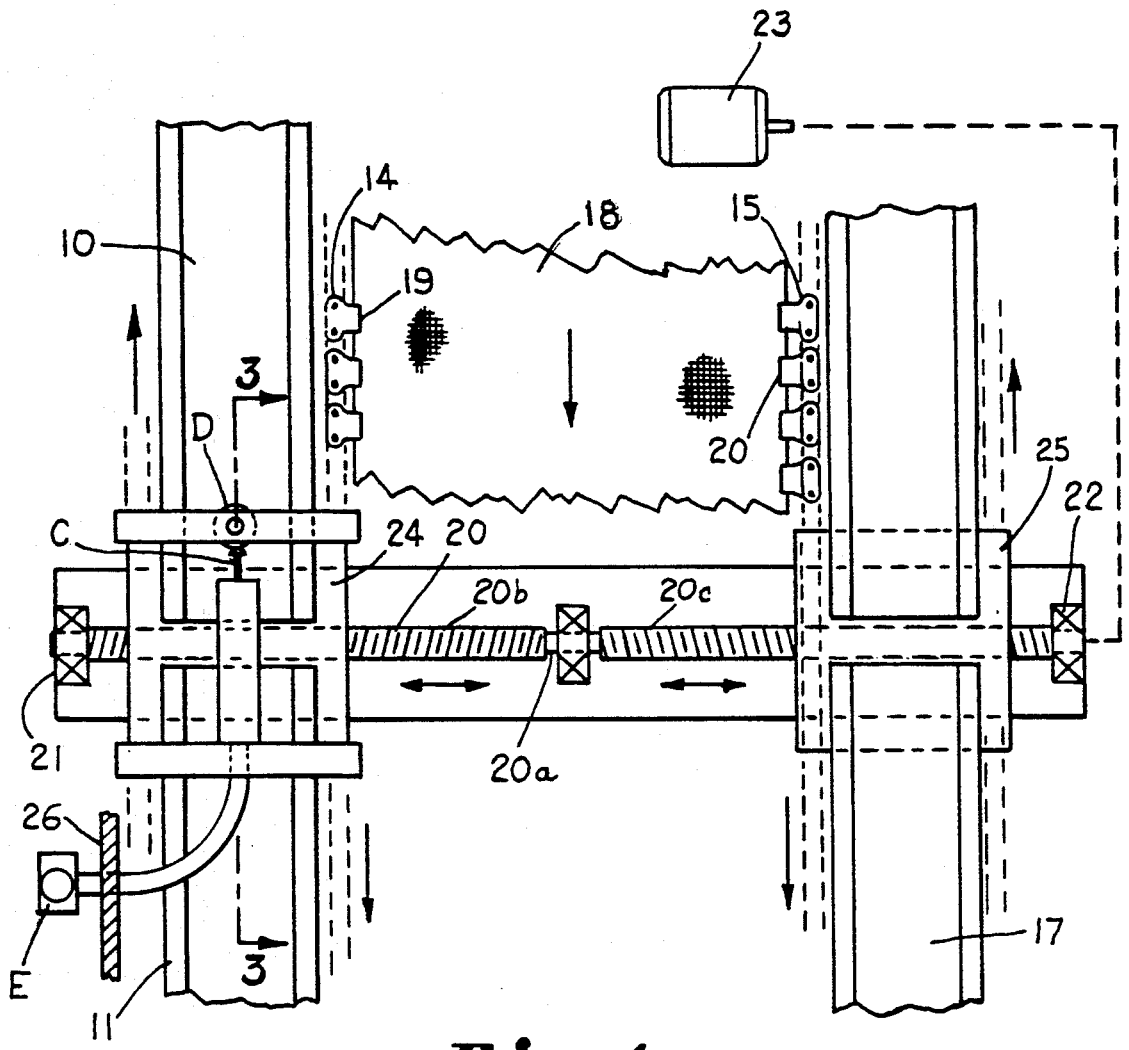
FIG. 1 is a schematic plan view illustrating a junction between adjusting rails of a tenter frame equipped with apparatus constructed in accordance with the invention.
Figure 2:
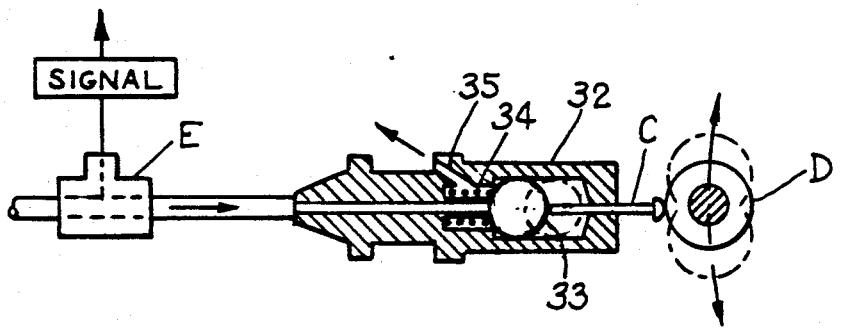
FIG. 2 is an enlarged plan view further illustrating a mechanism constructed in accordance with the present invention.

The rails in FIG. 1 are illustrated as being driven for transverse movement by a transverse adjusting screw 20. The transverse adjusting screw 20 is carried in bearings 21 and 22 adjacent each end. In addition to any other manual drive which may be provided, the adjusting screw is driven by a motor 23. The cross transverse adjusting screw 20 has an intermediate portion **20*a* without threads while the usual threaded ends are equipped with oppositely threaded portions 20*b* and 20*c* to move the rails in and out by suitable movement of the blocks 24 and 25 upon which the rails are mounted at their junctures as indicated by the arrows. The tenter frame is illustrated as being carried in an oven, the walls of which are designated at 26 in FIG. 1. The flow switch E may be located either inside the oven or outride the oven walls 26**, or may be used in a configuration which does not employ an oven.

FIG. 3 illustrates a pair of opposed brackets A and B. The bracket A is fixed to the rail section 10 by the bolt 30 and includes an upstanding flange 31 which carries the plunger valve having a plunger C. The plunger valve includes a housing 32 which carries a ball 33 therein held against the force of the spring 34 by the plunger C to maintain the valve in closed position. When, due to excessive movement, the plunger is no longer engaged by the cylindrical surface of the member D, fluid is permitted to flow through the passageway 35 causing air to flow in the direction of the arrow through the switch E which provides a signal deactivating the motor 23 bringing about a cessation in the movement of the rails.

The bracket B includes an angle 40 having an upstanding flange **40*a*. The angle 40 is fixed to the end of the rail 11 as by a bolt 42. An angle 43 has a flange 43*a*** attached to the flange 40*a*. The horizontal flange 43*b* carries a horizontal sliding member 44 which is fixed with respect to the flange 43*b* by a pair of screws 45 which pass through a slot 43*c*. By adjusting the position of the threaded shank 46 within internally threaded abutment 47 and fixing and tightening the nut 48, a horizontal adjustment may be had in the proximity of the cylindrical surface of member D with respect to the plunger C thus determining the extent of movement permitted the rails.

It will be noted in this regard that the member D is mounted for rotation upon the shank 50 of a depending member having threads 51 on one end for securement to the slide 44 and a head 52 on the other end to retain the rotatable member D.

While a preferred embodiment of the invention has been described using specific terms, such description is for illustrative purposes only, and it is to be understood that changes and variations may be made without departing from the spirit or scope of the following claims.

What is claimed is:

1. Apparatus for limiting the transverse movement of tenter frame rails having a transverse power driven adjusting device at each junction between rails in end to end relation comprising:

a pair of opposed brackets carried by respective ends of said rails;

a valve having a spring biased plunger carried by one of said brackets;

a member having a predetermined surface area opposite said plunger in contact therewith maintaining same in closed position against the action of said spring so long as the plunger is in contact with said surface; and a switch actuated by a flow of fluid flowing through said valve when said plunger is released by said surface, stopping said power driven adjusting device and transverse movement of said tenter frame rails.

2. The structure set forth in claim 1 including a support carried by one of said brackets mounting said member for rotation, said member having a cylindrical surface presented to said spring biased plunger.

3. The structure set forth in claim 2 wherein said support depends from a horizontal bracket portion, and means adjusting said bracket portion horizontally with respect to said valve to vary the extent of movement permitted to the rails.

* * * * *